US009302835B2

(12) United States Patent
Laske

(10) Patent No.: US 9,302,835 B2
(45) Date of Patent: Apr. 5, 2016

(54) EASY OPEN FLEXIBLE CONTAINER

(75) Inventor: Louis L. Laske, Libertyville, IL (US)

(73) Assignee: Vonco Products, Inc., Lake Villa, IL (US)

( * ) Notice: Subject to any disclaimer, the term of this patent is extended or adjusted under 35 U.S.C. 154(b) by 13 days.

(21) Appl. No.: 13/490,105

(22) Filed: Jun. 6, 2012

(65) Prior Publication Data

US 2012/0308166 A1 Dec. 6, 2012

Related U.S. Application Data

(60) Provisional application No. 61/493,851, filed on Jun. 6, 2011, provisional application No. 61/511,403, filed on Jul. 25, 2011.

(51) Int. Cl.
*B65D 33/00* (2006.01)
*B65D 75/58* (2006.01)

(52) U.S. Cl.
CPC ..... *B65D 75/5805* (2013.01); *B65D 75/5811* (2013.01)

(58) Field of Classification Search
CPC ..... B65D 75/5805; B65D 75/5833; B65D 75/5866
USPC ..... 383/201, 207–209, 61.2, 78, 906, 67, 383/77, 80, 93
See application file for complete search history.

(56) References Cited

U.S. PATENT DOCUMENTS

| | | | | | |
|---|---|---|---|---|---|
| 2,499,528 | A * | 3/1950 | Reitzes | 383/208 |
| 2,635,788 | A * | 4/1953 | Snyder et al. | 222/107 |
| 2,845,173 | A * | 7/1958 | Langdon | 206/363 |
| 3,069,066 | A * | 12/1962 | Peckham | 383/81 |
| 3,073,507 | A * | 1/1963 | Trewella et al. | 206/439 |
| 3,559,800 | A * | 2/1971 | Butler et al. | 383/208 |
| 3,687,358 | A * | 8/1972 | Wink et al. | 383/208 |
| 3,780,781 | A * | 12/1973 | Uramoto | 383/204 |
| 4,846,585 | A * | 7/1989 | Boeckmann et al. | 383/5 |
| RE33,674 | E * | 8/1991 | Uramoto | 383/204 |
| 5,613,779 | A * | 3/1997 | Niwa | 383/201 |
| 6,074,097 | A * | 6/2000 | Hayashi et al. | 383/209 |
| 6,241,132 | B1 * | 6/2001 | Morrison | 222/541.6 |
| 6,391,353 | B1 * | 5/2002 | Marbler et al. | 426/115 |
| 6,499,878 | B1 * | 12/2002 | Dobreski et al. | 383/5 |
| 7,073,692 | B2 * | 7/2006 | Weyts | 222/541.9 |
| 7,229,512 | B2 | 6/2007 | Streicher | |
| 7,395,642 | B2 * | 7/2008 | Plourde et al. | 53/412 |
| 7,581,371 | B2 * | 9/2009 | Owensby et al. | 53/459 |
| 8,297,841 | B2 * | 10/2012 | Bosman et al. | 383/207 |
| 8,701,947 | B2 * | 4/2014 | Weyts | 222/541.9 |
| 2003/0215165 | A1 * | 11/2003 | Hogan et al. | 383/206 |
| 2003/0235352 | A1 * | 12/2003 | Plourde et al. | 383/204 |
| 2005/0008268 | A1 * | 1/2005 | Plourde et al. | 383/207 |
| 2005/0031232 | A1 * | 2/2005 | Jammet et al. | 383/200 |
| 2006/0030471 | A1 * | 2/2006 | Schaller et al. | 493/213 |
| 2009/0041395 | A1 * | 2/2009 | Bossel et al. | 383/201 |
| 2012/0189232 | A1 * | 7/2012 | Anzini et al. | 383/203 |

* cited by examiner

*Primary Examiner* — Jes F Pascua
(74) *Attorney, Agent, or Firm* — Pauley Erickson & Kottis

(57) ABSTRACT

An easy open flexible container including two webs of material sealed together to form a containment area. At least one of the two webs includes at least two layers and one of the two layers includes a slit or perforation. The easy open flexible container further includes a heat seal joining the at least two layers together. The heat seal positioned over or adjacent to the slit or perforation to form a tearable track for opening the easy open flexible container.

6 Claims, 9 Drawing Sheets

EASY OPEN FLEXIBLE CONTAINER

CROSS-REFERENCE TO RELATED APPLICATIONS

This application claims the benefit of Provisional U.S. Patent Application No. 61/493,851 to Louis L. Laske, filed on 6 Jun. 2011, for an "Easy Open Flexible Container" and claims benefit of Provisional U.S. Patent Application No. 61/511,403 to Louis L. Laske, filed on 25 Jul. 2011, for an "Easy Open Flexible Container." These co-pending provisional patent applications are hereby incorporated by reference herein in their entirety and are made a part hereof, including but not limited to those portions which specifically appear hereinafter.

BACKGROUND OF THE INVENTION

1. Field of the Invention

This invention relates to a flexible container or package having a tearable portion to permit access to the contents thereof.

2. Description of Prior Art

When flexible containers are closed using a heat sealing method or non-peelable adhesive closure, they are generally difficult to open without literally ripping apart or using a scissor. It is preferable to provide an easy to open method of accessing the contents.

One method of assisting the access is to manufacture a bag with materials that are specifically designed to tear readily in one direction. However, these materials are much more costly than the normal flexible film and this higher cost could more than offset the benefit.

Another method would be to mechanically score or laser score one or more layers of the container to provide a weakened path for easier opening. This requires a very expensive machinery investment along with operating monitoring and maintenance. Since it is very difficult to measure the depth of scoring, trial and error method is used to determine the right settings. The laser setting must be manually or automatically adjusted to materials feet per minute changes. Likewise, material gauge variance may create issues with this method.

Streicher, U.S. Pat. No. 7,229,512, teaches still another method for providing easy opening. This method is used at the tip of a whipped topping or frosting dispenser and includes a series of small hot needle or hot pin holes across the desired opening area. These holes seal the two webs of the container together keeping the container leak proof while providing a weakened line to pull or snap off the end of the container. The problem with this method is that the edge of the container that is adjacent to the contents of the bag is still sealed together at the hot needle points requiring that these seals be overcome when trying to dispense the contents. The edge of the opening is ragged due to the pin seals and subsequent stretching when pulled or torn open.

An easy to open, cost-effective package is desirable and described in more detail below.

SUMMARY OF THE INVENTION

The present invention relates to a flexible container or package that provides an easier to tear open location. The arrangement of the present invention may be applied to any number of packages or containers requiring a directional, easy open feature including, for example, but not limited to, a frosting bag, a specimen container and a snack package. As used herein, the terms "container" and "package" are used interchangeably.

The easy open flexible container of the invention includes a bag with a main body connected to a tearable portion. This combination provides a container that is easier to open than conventional bags and economical to produce. In an embodiment of this invention, the easy open flexible container includes a pair of webs forming the main body and a linear tear material forming at least a portion of the tearable portion. The pair of webs are preferably sealed with respect to each other about at least a portion of a periphery of the main body to form a containment area between the pair of webs. The pair of webs may further include at least one opening. The pair of webs preferably comprise a low cost material such as low-density polyethylene, high-density polyethylene or any other low cost material. The linear tear material is preferably attached to at least one of the pair of webs with a heat seal and/or an adhesive connection to further enclosed the containment area. As described herein, the linear tear material is preferably a material or blend of materials that allows directional, such as machine direction, linear tear. INSTATEAR™ manufactured by Favorite Plastics is one such material. This method works very well as it provides a clean, consistent tear open method while using the more expensive linear tear materials on only a very small portion of the container.

In another preferred embodiment of this invention, the flexible container comprises a specimen bag, preferably having a tamper-evident feature. Specifically, the specimen bag may include a main body with a pair of webs defining a containment area, a relatively small section of linear tear material adhered to an end of the main body and a closure with a tamper-evident, exposable seal or adhesive connected to one of the main body and the small section of linear tear material. The main body preferably includes a pair of webs sealed about a portion of the perimeter creating a first opening and a second opening. The linear tear material is preferably connected to the main body with a hot seal or an adhesive at the first opening. The closure is preferably connected to the main body with a hot seal or an adhesive at the second opening. With this arrangement, a user can place a specimen in the main body through the closure and seal up the closure by exposing the tamper evident seal and pressing the seal against one of the webs of the main body. Subsequently, the user or another user can access the specimen by tearing through the linear tear material and be certain that the specimen has not been tampered with.

According to a preferred embodiment of this invention, a small hot cut or cold cut in a side or periphery of the bag, preferably outside of the inside edge of the sealed area, is included. The small cut provides a starting point for snapping and/or tearing off the end of the container to provide ready access to the contents.

In an alternative embodiment of this invention, the flexible container includes a slit or perforation in one or more of the web layers or the linear tear material such that when opening the container by pulling at the desired location, the container will tear open much more readily at this slit or perforated location. While this method of weakening at least one of the webs at the desired location is functional as described, there may be a tendency for one or more of the non slit or perforated layers to take its own tear track when tearing open providing a less than desirable appearance. To overcome this tendency, a heat seal may be used to attach layers of material together at a location covering the slit or perforation or adjacent to the slit or perforation on one or both sides of the slit or perforation while not allowing each web to seal or otherwise attach to each other at the slit or perforation area. This method of sealing or otherwise attaching the layers of materials at the slit or perforation provides a track for tearing which results in a clean and consistent opening for accessing the contents of the bag.

In another alternative embodiment of this invention, the easy open flexible container includes two identical webs of heat sealable materials, each with two layers of an material and thickness. These two layers may be the same or different types of materials. This is known as double wound sheeting (DWS). At one container location, a slit or perforation would be put in one layer of one or both webs and the two layers of the web or webs with the slit or perforations would be sealed together on top of or adjacent to the slit or perforation area. This method does not require any additional materials cost and provides a positive tear area that has both direction control and approximately one half of the materials strength at the tear line.

BRIEF DESCRIPTION OF THE DRAWINGS

The following and other features and objects of this invention will be better understood from the following detailed description taken in conjunction with the drawings wherein.

DESCRIPTION OF PREFERRED EMBODIMENTS

Figure 1:
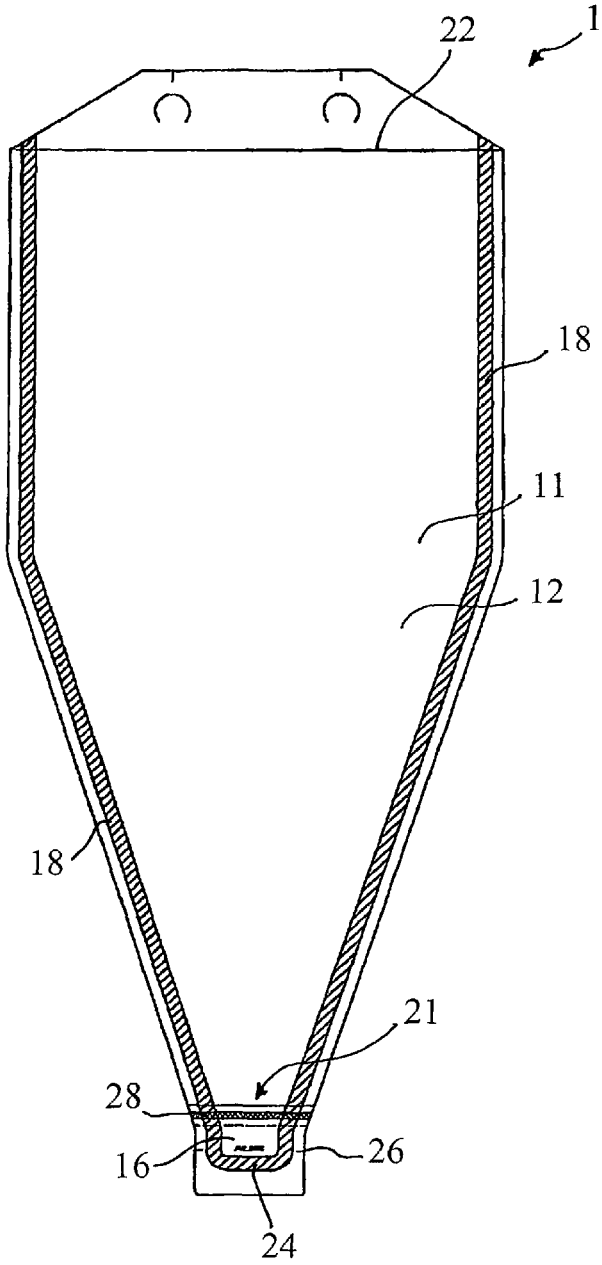
FIG. 1 shows a front view of an easy open flexible container for whipped topping according to one embodiment of this invention.
Figure 2:
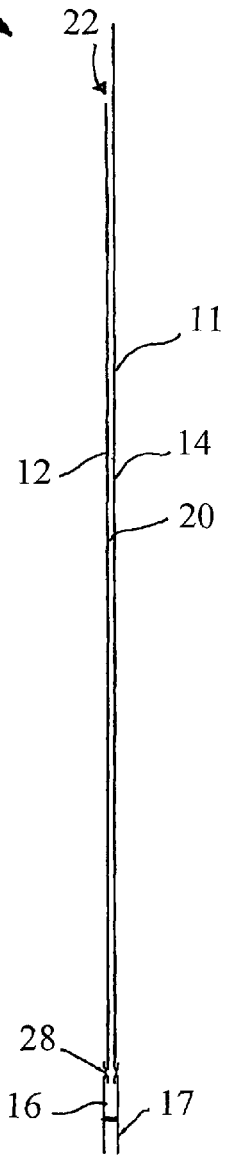
FIG. 2 shows a cross-sectional view of the easy open flexible container shown in FIG. 1.

In one preferred embodiment of this invention, as shown in FIGS. 1 and 2, a flexible container 10 comprises a main body 11 having a first web of material 12 sealed to a second web of material 14 and at least one layer of a linear tear material 16, 17 connected to at least one of the first web of material 12 and the second web of material 14. In a preferred embodiment, the first web of material 12 and the second web of material 14 comprise a low-cost material such as, but not limited to, a low-density polyethylene (LDPE) and a high-density polyethylene (HDPE). Further, the linear tear material 16, 17 preferably comprises a material or a blend of materials that allows directional linear tear. INSTATEAR™ manufactured by Favorite Plastics is one such material.

Throughout this specification, as discussed above, the flexible container will be described as having a first web of material and a second web of material. As used herein, "web" is defined as one or more layers of flexible material within the package or container, whether laminated or not. However, it should be understood, that the first web of material and the second web of material may be separate pieces of material or may be a single piece of material that is folded or otherwise formed to have a space in between to hold or store something. Further, each of the first web of material and/or the second web of material may comprise multiple layers of the same or different materials and having the same or different material thickness gauges, depending on a particular purpose of the flexible container. Similarly, it should be understood, that a first web linear tear material and a second web of linear tear material may be separate pieces of material or may be a single piece of material that is folded or otherwise formed. Further, each of a first linear tear material and/or a second linear tear material may comprise multiple layers of the same or different materials, depending on a particular purpose of the flexible container.

Throughout this Specification, the flexible container of this invention includes various seals including seals to join various parts of the flexible container and to provide a track for tearing open the flexible container. It should be understood that these seals may be formed using any method known to one having ordinary skill in the art including, but not limited to, a hot seal, a cold seal, a bar seal, a bar seal with a skirt, a wide seal, a hot cutoff seal and a sidewall bag seal.

In the embodiment of FIG. 1, the first web of material 12 and the second web of material 14 have a tapered shape with the linear tear material 16, 17 connected to each web of material 12, 14 of the flexible container 10 at an end of the tapered shape and including an opening 22 opposite the tapered end. This shape and opening are useful for the application of frosting, whipped cream or whipped topping to a dessert. However, the flexible container 10 of this invention is not limited to this shape and may have any shape and may or may not include the opening 22, as necessary for a particular purpose. Further, while the drawings show a specific use and location for the linear tear material 16, 17, this invention permits the linear tear material 16, 17 to be located anywhere on the flexible container 10 and on one or both webs 12, 14 of the container. This method permits the use of a lower cost flexible material to be used for the vast majority of the container and using this linear tear material on only a portion of the bag increasing the container materials cost by a small percentage.

Preferably, the first web of material 12 and the second web of material 14 are heat sealed to form one or more sealed edges 18 about a portion of a periphery of the flexible container 10, as shown in FIG. 1. Any other suitable process for sealing, as known to those skilled in the art, can also be used to form the one or more sealed edges 18, for example, but not limited to, an adhesive seal. In the embodiment of FIG. 1, the sealed edges 18 run along two edges of the first and second webs of material 12, 14. The sealed edges 18 at least partially define a containment area 20 between the first web of material 12 and the second web of material 14. The sealed edges 18 also define an opening 22 at a top of the first and second webs of material 12, 14, allowing access to the containment area 20. Alternatively, the opening 22 may be closed with a seal to further enclose the containment area 20.

As shown in FIG. 1, at an opposite end to the opening 22, the linear tear material 16, 17 is attached to at least one of the first web of material 12 and the second web of material 14 over a non-sealed opening to form a sealed openable end 21 of the main body 11. Preferably, a connection 28 between the linear tear material 16, 17 and the first or second web 12, 14 is formed with a heat seal connection. Alternatively, any other suitable process for attaching the linear tear material 16, 17, as known to those skilled in the art, can be used, for example an adhesive connection. As described above, each of two webs 12, 14 of the flexible container 10 may include one or multiple layers of flexible material. The linear tear material 16, 17 may be attached to an inside of the webs of material 12, 14, between layers of each web of material 12, 14, or on top (outside) of the layers of one or both webs of material 12, 14.

In the embodiment of FIG. 1, the linear tear material 16, 17 further includes a tear material sealed edge 24. The tear material sealed edge 24 preferably connects to the sealed edge 18 of the main body 11 to at least partially enclose the containment area 20. Preferably, the tear material sealed edge 24 is formed with the same process as the sealed edge 18 of the main body 11, for example a heat seal and/or an adhesive connection. However, any other suitable process for sealing, as known to those skilled in the art, can be used. Alternatively, the flexible container 10 may not include the tear material sealed edge 24 and a closed bottom edge of the linear tear material 16, 17 may be created by folding or forming the layer of linear tear material 16, 17.

According to a preferred embodiment of this invention, the linear tear material 16, 17 further includes a small cut 26, preferably positioned outside of an inside edge of the tear material sealed edge 24, that acts as a starting point for snapping and/or tearing off an end of the flexible container 10 to provide ready access to contents stored in the containment area 20. The small cut 26 is preferably formed with a small hot cut or a small cold cut, however, the small cut 26 may be formed with any process known to those skilled in the art. In some applications it is not necessary or preferable to include the small cut 26 in the linear tear material 16, 17 to initiate the tear opening of the flexible container 10. In other applications, where the desired tear opening is to occur at a specific location, the small cut 26 may be formed on one or both sides of the linear tear material 16, 17.

Figure 4:
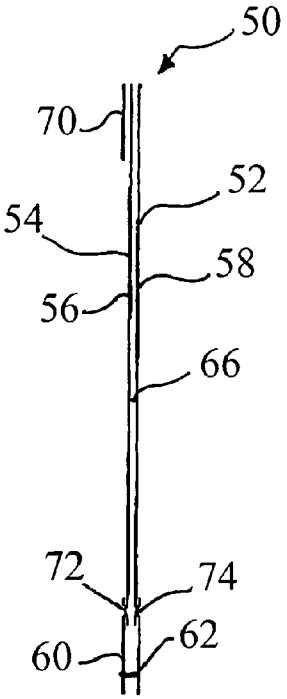
FIG. 4 shows a cross-sectional view of the easy open specimen bag shown in FIG. 3.
Figure 3:
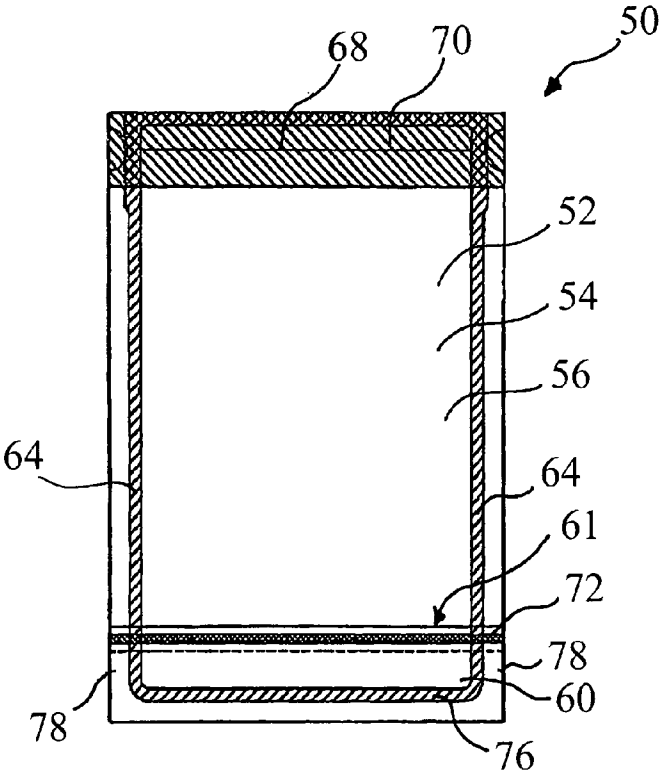
FIG. 3 shows a front view of an easy open specimen bag according to another embodiment of this invention.

FIGS. 3 and 4 show another embodiment of a flexible container 50 of this invention with a similar construction as the embodiment shown in FIG. 1. In this embodiment, the flexible container 50 is a specimen bag 52, preferably having a tamper evident feature. The specimen bag 52 preferably includes a main body 54 having a first web of material 56 sealed to a second web of material 58. The main body 54 includes a sealed openable end 61. At the sealed openable end 61, a first linear tear material 60 connected to the first web of material 56 and a second linear tear material 62 connected to the second web of material 58. In a preferred embodiment, the first web of material 56 and the second web of material 58 comprise a low-cost material for example, but not limited to, a low-density polyethylene (LDPE) and a high-density polyethylene (HDPE). Further, the first linear tear material 60 and the second linear tear material 62 preferably include a material or a blend of materials that allows directional linear tear. INSTATEAR™ manufactured by Favorite Plastics is one such material.

Preferably, the first web of material 56 and the second web of material 58 are heat sealed to form one or more sealed edges 64 about a portion of a periphery of the main body 54, as shown in FIG. 3. Any other suitable process for sealing, as known to those skilled in the art, can also be used to form the one or more sealed edges 64, for example, but not limited to, an adhesive seal. In the embodiment of FIG. 3, the sealed edges 64 run along the edges of the first and second webs of material 56, 58. The sealed edges 64 at least partially define a containment area 66 between the first web of material 56 and the second web of material 58.

In a preferred embodiment, at the top of FIG. 3, the specimen bag 52 includes an opening 68 with a bag closure 70. The opening 68 provides access to the containment area 66. The bag closure 70 preferably provides a sealable closure to the opening 68. In an embodiment of this invention, the bag closure 70 preferably includes a flap with an adhesive strip covered by removable tape to provide a tamper evident feature. In an alternative embodiment, the bag closure 70 may comprise any type of closure known to one of ordinary skill in the art with or without a tamper evident feature including, but not limited to, a peel closure and a zip closure.

As shown in FIGS. 3 and 4, at an opposite end to the opening 68, the first web of material 56 is attached to the first linear tear material 60 with a first connection 72 and the second web of material 58 is attached to the second linear tear material 62 with a second connection 74. Preferably, the first connection 72 and the second connection 74 are formed with a heat seal connection and/or an adhesive connection. Alternatively, any other suitable process, known to those skilled in the art, for forming a connection can be used.

In a preferred embodiment, the first linear tear material 60 is joined to the second linear tear material 62 with a tear material sealed edge 76. The tear material sealed edge 76 preferably connects to the sealed edge 64 of the main body 54 to at least partially enclose the containment area 66. Preferably, the tear material sealed edge 76 is formed with the same process as the sealed edge 64 of the main body 54, for example a heat seal and/or an adhesive seal. However, any other suitable process for sealing, as known to those skilled in the art, can be used. Alternatively, a sealed bottom edge of the linear tear material 60, 62 may be formed by folding a piece of the linear tear material 60, 62.

According to a preferred embodiment of this invention, at least one of the first linear tear material 60 and the second linear tear material 62 includes a small cut 78, preferably positioned outside of an inside edge of the tear material sealed edge 76, that acts as a starting point for snapping and/or tearing off an end of the flexible container 50 to provide ready access to contents stored in the containment area 66. The small cut 78 is preferably formed with a small hot cut or a small cold cut, however, the small cut 78 may be formed with any process known to those skilled in the art. In some applications it is not necessary or preferable to include the small cut 78 in the linear tear material 60, 62 to initiate the tear opening of the flexible container 50. In other applications, where the desired tear opening is to occur at a specific location, the small cut 78 may be formed on both sides of the linear tear material.

In operation, a user can place a specimen in the containment area 66 of the specimen bag 52 using the opening 68 and can seal up the opening 68 by exposing the tamper evident adhesive on the bag closure 70 and pressing the bag closure 70 against one of the webs 56, 58 of the main body 54 to seal the opening 68. Subsequently, the user or another user can access the specimen by tearing through the linear tear material 60, 62.

Figure 6:
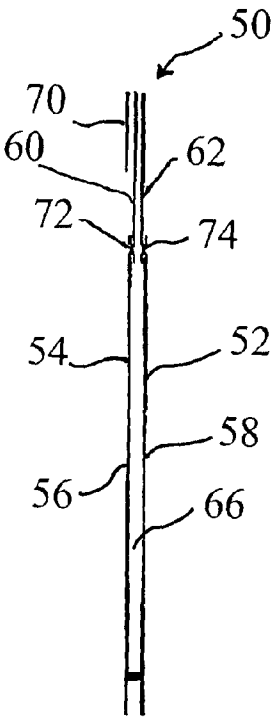
FIG. 6 shows a cross-section view of the easy open specimen bag shown in FIG. 5.
Figure 5:
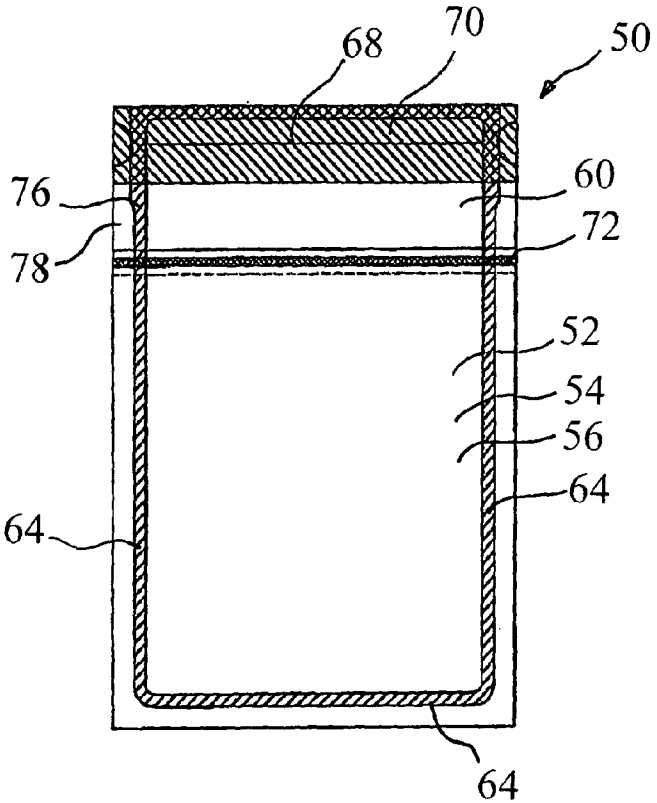
FIG. 5 shows a front view of another embodiment of the easy open specimen bag of this invention.
Figure 8:
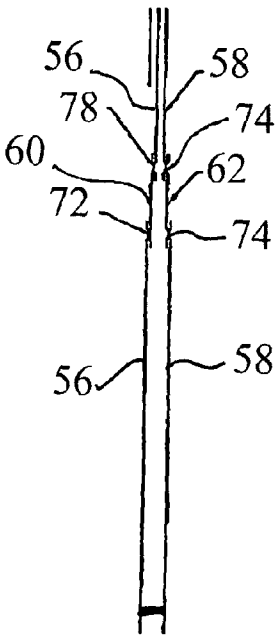
FIG. 8 shows a cross-section view of the easy open specimen bag shown in FIG. 7.
Figure 7:
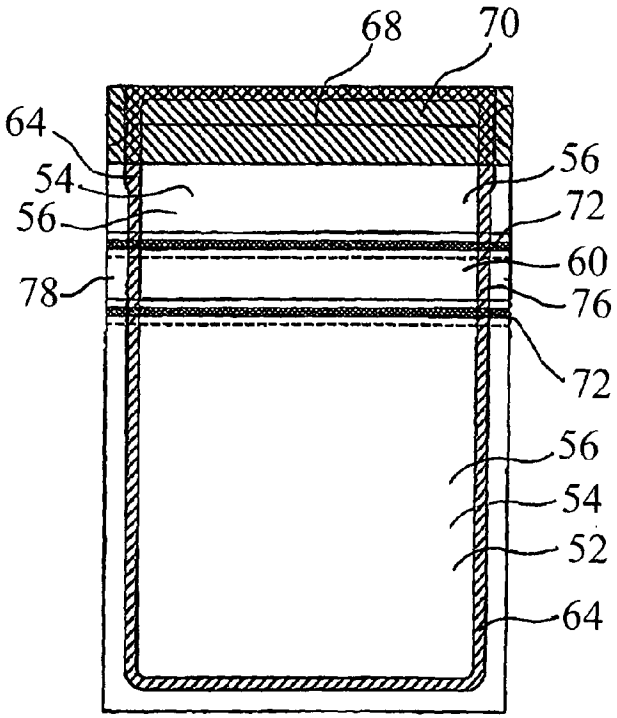
FIG. 7 shows a front view of another embodiment of the easy open specimen bag of this invention.

FIGS. 5-8 show alternative embodiments of the specimen bag 52 with the linear tear material 60, 62 positioned in a variety of locations. In the embodiment of FIGS. 5 and 6, the opening 68 and the bag closure 70 are joined to the linear tear material 60, 62 on one side of the flexible container 50 and the main body 54 includes the sealed edge 64 on three sides on the other side of the flexible container 50. In the embodiment of FIGS. 7 and 8, the linear tear material 60, 62 is positioned between two sets of the web of material 56, 58 and with the opening 68 and the bag closure 70 positioned on one of the two sets of the web of material.

Figure 10:
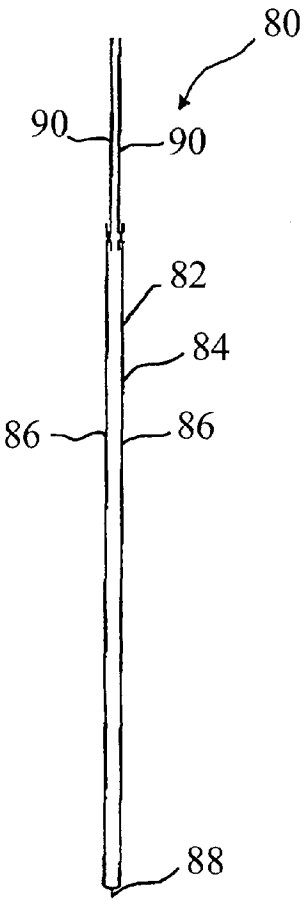
FIG. 10 shows a side view of the easy open flexible container shown in FIG. 9.
Figure 9:
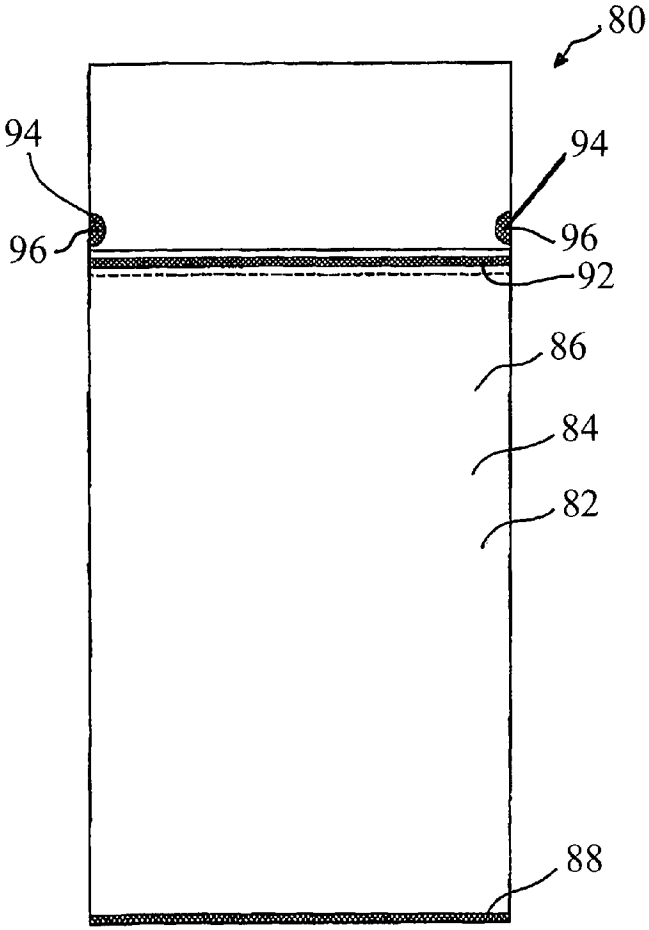
FIG. 9 shows a front view of an easy open flexible container according to another embodiment of this invention.

FIGS. 9 and 10 show another embodiment of a flexible container 80 of this invention with a similar construction as the embodiment shown in FIG. 1. In this embodiment, the flexible container 80 is a bag 82 for storing items. The bag 82 preferably includes a main body 84 having a web of material 86 formed with side seals and sealed at a bottom edge 88 with a heat seal. The bag 82 further includes a linear tear material 90 formed with side seals and connected to the web of material 86 at a bottom edge of the linear tear material with a heat seal connection 92. In an embodiment of this invention, the bag 82 further includes a heat seal tab 94 positioned along at least one edge of the bag 82 that acts a starting point for tearing open the bag 82. Preferably, the bag 82 further includes a small cut 96 positioned within the heat seal tab 94 to help initiate a tear through the linear tear material 90. The small cut 96 may be a hot cut or a cold cut, as appropriate. In a preferred embodiment, after the main body 84 is filled with an item to be stored, a top edge of the linear tear material 90 is sealed to enclose the item to be stored.

Figure 11:
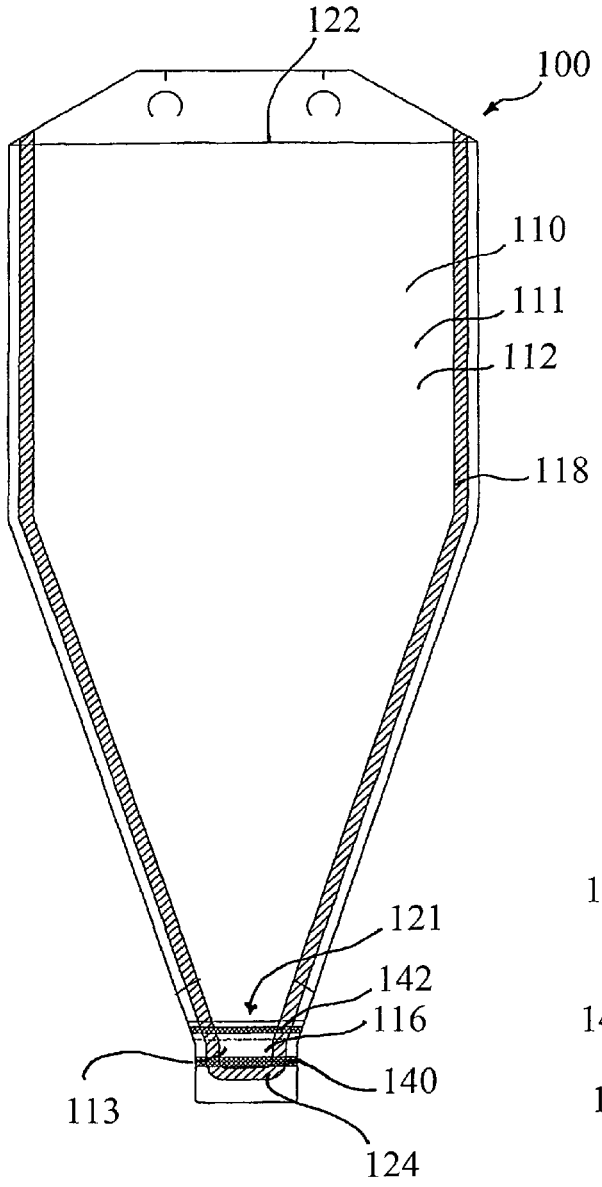
FIG. 11 shows a front view of an easy open flexible container with an overlapping single seal arrangement according to another embodiment this invention.
Figure 12:
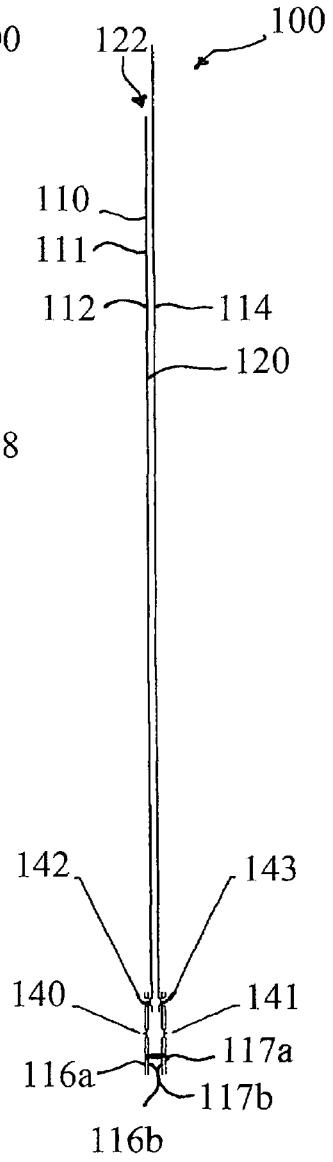
FIG. 12 shows a cross-sectional view of the easy open flexible container shown in FIG. 11.

FIGS. 11 and 12 show an alternative embodiment of a flexible container 100 with an overlapping single seal arrangement 140, 141. The flexible container 100 of this embodiment is a tapered frosting dispenser bag 110 with a main body 111 and a tearable portion 113. The main body 111 includes a first web of material 112 and a second web of material 114 that are heat sealed together with one or more sealed edges 118 about at least a portion of a periphery of the flexible container 100. The sealed edges 118 run along two edges of the first and second webs of material 112, 114 forming a containment area 120 and an opening 122. Alternatively, the flexible container 100 may not include the opening 122 and may include another seal to further enclose the containment area 120.

As shown in FIG. 11, opposite to the opening 122, the first web of material 112 is connected to a third web of material 116 at a gap 121 between the sealed edges 118 and the second web of material 114 is connected to a fourth web of material 117 at the gap 121 between the sealed edges 118. In a preferred embodiment, the third web of material 116 and the fourth web of material 117 each comprise a linear tear material however, the third web of material 116 and the fourth web of material 117 may not comprise a linear tear material. The third web of material 116 and the fourth web of material 117 are joined to each other with a tearable portion sealed edge 124. The tearable portion sealed edge 124 preferably connects to the sealed edge 118 of the main body 111 to at least partially enclose the containment area 120. Preferably, the tearable portion sealed edge 124 is formed with the same process as the sealed edge 118 of the main body 111, for example a heat seal and/or an adhesive seal.

As best shown in FIG. 12, the third web of material 116 comprises at least two layers of material, an outer layer of material 116*a* and an inner layer of material 116*b*. Likewise, the fourth web of material 117 comprises at least two layers of material, an outer layer of material 117*a* and an inner layer of material 117*b*. As best shown in the cross-section view of FIG. 12, the first web of material 112 is preferably connected to at least one layer of the third web of material 116*a*, 116*b* at a first seal 142. Similarly, the second web of material 114 is preferably connected to at least one layer of the fourth web of material 117*a*, 117*b* at a second seal 143. Each of the seals 142, 143 is preferably formed with a heat seal. However, any other process for sealing, known to those skilled in the art can be used.

As shown in FIGS. 11 and 12, the outer layer of material 116*a* and the inner layer of material 116*b* include an overlapping single seal arrangement 140. Similarly, the outer layer of material 117*a* and the inner layer of material 117*b* also include an overlapping single seal arrangement 141. Each of the overlapping single seal arrangements 140, 141 include a slit or perforation in at least one of the outer layer of material 116*a*, 117*a* and the inner layer of material 116*b*, 117*b* with a heat seal over the slit or perforation joining a respective outer layer of material 116*a*, 117*a* to a respective inner layer of material 116*b*, 117*b*. Alternatively, the heat seal may be positioned adjacent to the slit or perforation joining the outer layer of material to the inner layer of material. The overlapping single seal arrangement 140, 141 provides a tear strip that provides a clean and consistent tear through the flexible container of this invention.

Figure 14:
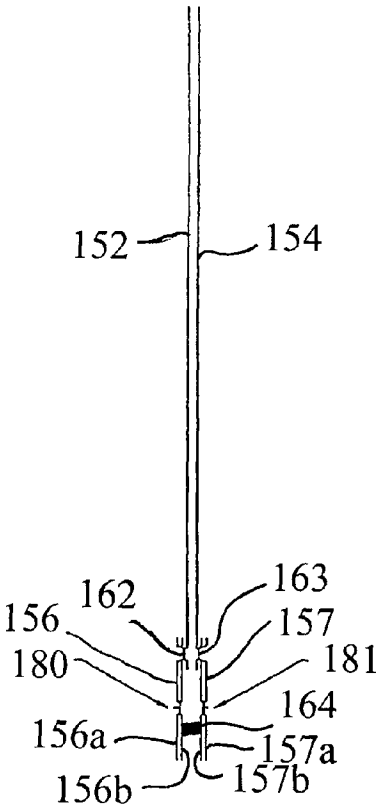
FIG. 14 shows a cross-sectional view of the easy open flexible container shown in FIG. 13.
Figure 13:
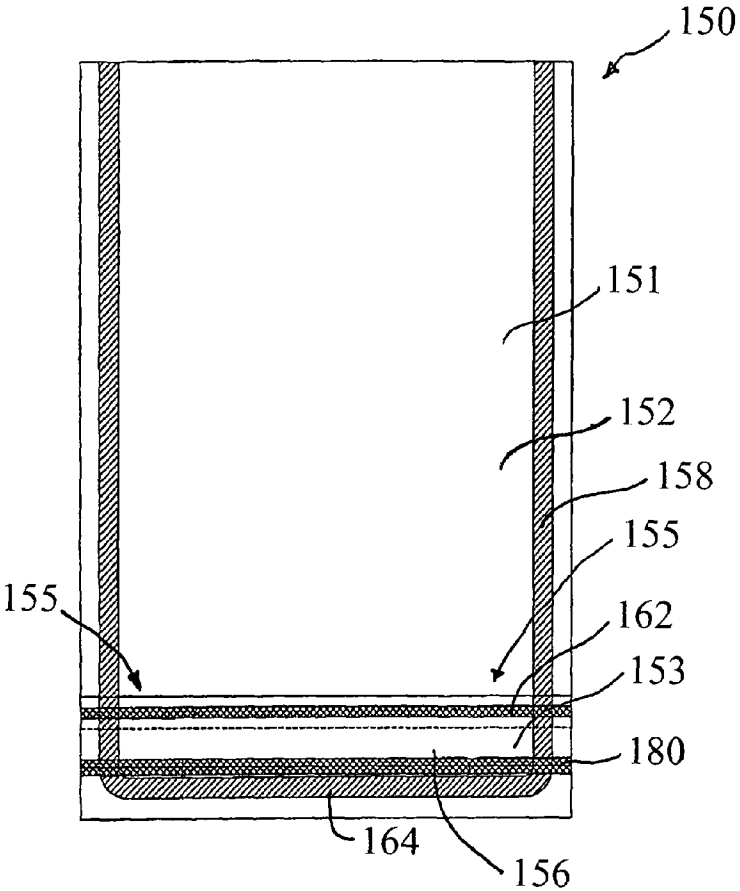
FIG. 13 shows a front view of another embodiment of an easy open flexible container with an overlapping single seal arrangement.

FIGS. 13 and 14 show an alternative embodiment of a flexible container 150 with an overlapping single seal arrangement 180, 181 similar to the single seal arrangement 140, 141 described in connection with FIGS. 11 and 12 above. In this embodiment, the flexible container 150 is a rectangular-shaped container with a main body 151 and a tearable portion 153. The main body 151 includes a first web of material 152 and a second web of material 154 that are heat sealed together with one or more sealed edges 158 about at least a portion of a periphery of the flexible container 150 and including a gap 155 between the one or more sealed edges 158. In this embodiment, the first web of material 152 is connected to a third web of material 156 with a heat seal connection 162 and the second web of material 154 is connected to a fourth web of material 157 with a heat seal connection 163.

As shown in FIGS. 13 and 14, the third web of material 156 and the fourth web of material 157 are joined to each other with a tearable portion sealed edge 164. As best shown in FIG. 14, the third web of material 156 comprises at least two layers of material, an outer layer of material 156*a* and an inner layer of material 156*b*. Likewise, the fourth web of material 157 comprises at least two layers of material, an outer layer of material 157*a* and an inner layer of material 157*b*. As best shown in FIGS. 13 and 14, the outer layer of material 156*a* and the inner layer of material 156*b* include an overlapping single seal arrangement 180. Similarly, the outer layer of material 157*a* and the inner layer of material 157*b* also include an overlapping single seal arrangement 181. Each of the overlapping single seal arrangements 180, 181 include a slit or perforation in either the outer layer of material 156*a*, 157*a* or the inner layer of material 156*b*, 157*b* with a heat seal over the slit or perforation joining the outer layer of material to the inner layer of material. Alternatively, the heat seal may be positioned adjacent to the slit or perforation joining the outer layer of material to the inner layer of material.

Figure 15:
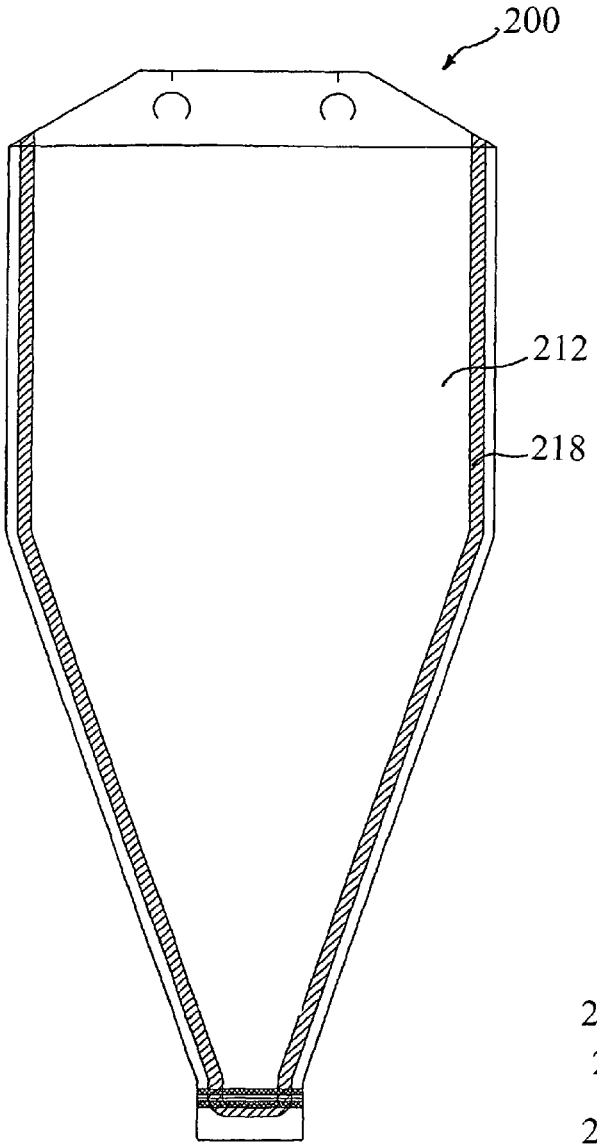
FIG. 15 shows a front view of an easy open flexible container with an adjacent double seal arrangement according to another embodiment this invention
Figure 16:
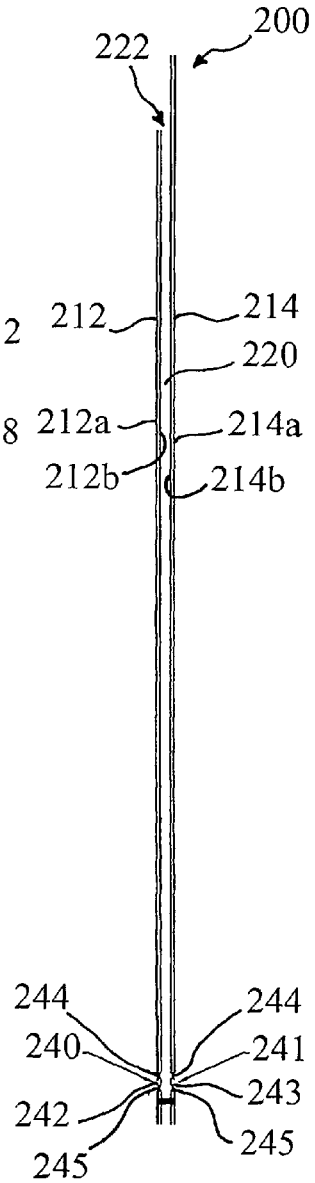
FIG. 16 shows a cross-sectional view of the easy open flexible container shown in FIG. 15.

FIGS. 15 and 16 show another embodiment of a flexible container 200 with an adjacent double seal arrangement 240, 241. The flexible container 200 of this embodiment is a tapered frosting dispenser bag 210 with a first web of material 212 and a second web of material 214 that are heat sealed together with a sealed edge 218 which extends across at least a portion of a periphery of the flexible container 200. The sealed edge 218 run forms a containment area 220 and an opening 222. Alternatively, the flexible container 200 may not include the opening 222 and may include another seal to further enclose the containment area 220.

As best shown in FIG. 16, the first web of material 212 comprises at least two layers of material, an outer layer of material 212*a* and an inner layer of material 212*b*. Likewise, the second web of material 214 comprises at least two layers of material, an outer layer of material 214*a* and an inner layer of material 214*b*. In this embodiment, each layer of the first web of material 212*a*, 212*b* and the second web of material 214*a*, 214*b* may comprise a low-cost material and/or a linear tear material depending on the desired qualities of tear strength and cost. In this embodiment, the outer layer of material 212*a* may comprise the same material as the inner layer of material 212*b*. However, the outer layer of material 212*a* need not comprise the same material as the inner layer of material 212*b*. For example, the outer layer of material 212*a* may comprise the linear tear material, while the inner layer of material 212*b* may comprise the low-cost material.

As best shown in the cross-section view of FIG. 16, the outer layer of the first web of material 212*a* and the inner layer of the first web of material 212*b* include the double seal arrangement 240. Similarly, the outer layer of the second web of material 214*a* and the inner layer of the second web of material 214*b* also include the double seal arrangement 241. Each of the double seal arrangements 240, 241 include a slit or perforation 242, 243 in at least one of the outer layer of material 212*a*, 214*a* and the inner layer of material 212*b*, 214*b* with a pair of heat seals 244, 245 positioned adjacent to each of the slits or perforations 242, 243. The double seal arrangement 240, 241 provides a track for the flexible container to be torn along providing a clean and consistent tear through of the first and second webs of materials 212, 214.

Figure 18:
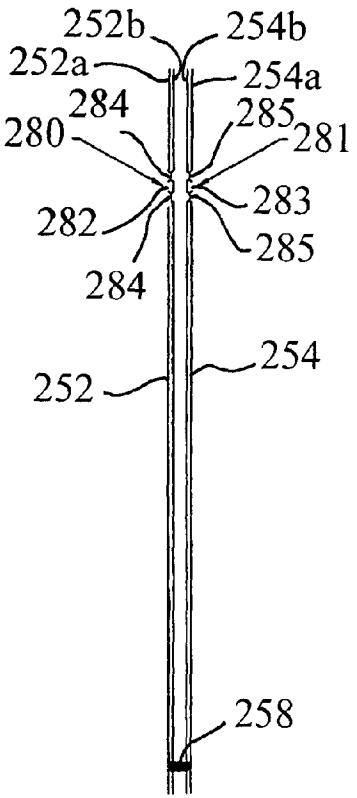
FIG. 18 shows a cross-sectional view of the easy open flexible container shown in FIG. 17.
Figure 17:
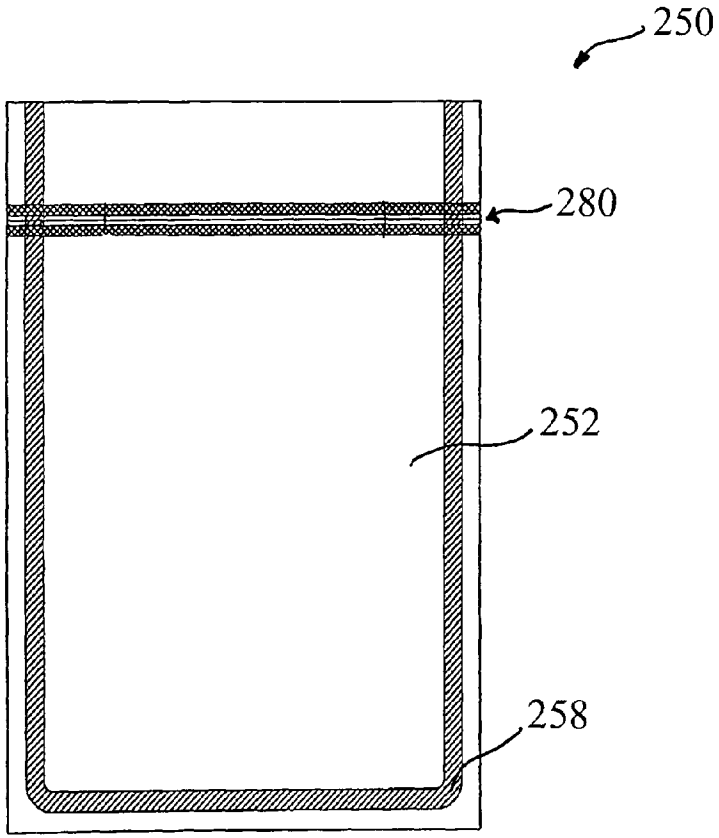
FIG. 17 shows a front view of another embodiment of an easy open flexible container with an adjacent double seal arrangement.

FIGS. 17 and 18 show an alternative embodiment of a container 250 with a double seal arrangement 280, 281 similar to the double seal arrangement 240, 241 described above. The container 200 of this embodiment is square-shaped bag with a first web of material 252 and a second web of material 254 that are heat sealed together with a sealed edge 258 which extends around at least a portion of a periphery of the flexible container 250. As best shown in FIG. 18, the first web of material 252 comprises at least two layers of material, an outer layer of material 252*a* and an inner layer of material 252*b*. Likewise, the second web of material 254 comprises at least two layers of material, an outer layer of material 254*a* and an inner layer of material 254*b*. In this embodiment, each layer of the first web of material and the second web of material may comprise a low-cost material and/or a linear tear material depending on the desired qualities of tear strength and cost. As best shown in the cross-section view of FIG. 18, the outer layer of the first web of material 252*a* and the inner layer of the first web of material 252*b* include the double seal arrangement 280. Similarly, the outer layer of the second web of material 254*a* and the inner layer of the second web of material 254*b* also include the double seal arrangement 281. Each of the double seal arrangements 280, 281 include a slit or perforation 282, 283 in at least one of the outer layer of material 252*a*, 254*a* and the inner layer of material 252*b*, 254*b* with a pair of heat seals 284, 285 positioned adjacent to each of the slits or perforations 282, 283.

While the drawings show a number of locations for the tear opening, it should be understood that this invention permits the linear tear material to be located anywhere in the container on one or both webs of the container. This method permits the use of a lower cost flexible material to be used for the vast majority of the container and using this linear tear material on only a portion of the bag increasing the container materials cost by a small percentage.

While in the foregoing specification this invention has been described in relation to certain preferred embodiments thereof, and many details have been set forth for purposes of illustration, it will be apparent to those skilled in the art that the apparatus is susceptible to additional embodiments and that certain of the details described herein can be varied considerably without departing from the basic principles of the invention.

What is claimed is:

1. A flexible container comprising:

a first web of material formed of a first flexible material;

a second web of material connected to the first web of material by a sealed edge to form a containment area between the first web of material and the second web of material, wherein the flexible container is a pastry bag comprising a tapered shape that is tapered between a first end to a tapered end;

a non-sealed opening formed at the tapered end and between the first web of material and the second web of material, the opening in combination with the containment area;

a third web of material connected to at least the first web of material by a sealed connection and over the non-sealed opening between the first web of material and the second web of material, the third web of material formed entirely of a second flexible material that is a different material from the first flexible material, wherein the second flexible material comprises a linear tear material film manufactured to provide directional linear tear; and a slit formed of a single cut in the third web of material, wherein the cut is aligned at a side of the containment area to begin the directional linear tear across the third web of material and across the containment area to open the container via the directional linear tear.

2. The flexible container of claim 1, further comprising:

a fourth web of material connected the second web of material by a second scaled connection, the fourth web of material formed of the second flexible material and including a second slit; and a second sealed edge sealing the third web of material to the fourth web of material.

3. The flexible container of claim 2, wherein the slit is aligned over the second slit.

4. The flexible container of claim 2, wherein the second sealed edge is formed between the containment area and the slit.

5. The flexible container of claim 1, further comprising:

a second opening in the flexible container at the first end to access the containment area; and a bag closure attached to the flexible container at a position adjacent to the second opening, wherein the bag closure secures the second opening to close the containment area.

6. The flexible container of claim 1, wherein the containment area is continuous between the non-sealed opening and the slit.

* * * * *